US006849792B2

(12) United States Patent
Yeakel

(10) Patent No.: US 6,849,792 B2
(45) Date of Patent: Feb. 1, 2005

(54) GUITAR PICKUP SUPPORT ASSEMBLY

(75) Inventor: Nathan W. Yeakel, Sunnyvale, CA (US)

(73) Assignee: Gibson Guitar Corp., Nashville, TN (US)

( * ) Notice: Subject to any disclaimer, the term of this patent is extended or adjusted under 35 U.S.C. 154(b) by 0 days.

(21) Appl. No.: 10/339,372

(22) Filed: Jan. 9, 2003

(65) Prior Publication Data

US 2004/0134328 A1 Jul. 15, 2004

(51) Int. Cl.[7] ..... G10D 3/04

(52) U.S. Cl. ..... 84/298; 84/299; 84/307; 84/723; 84/726; 84/731

(58) Field of Search ..... 84/298, 299, 307, 84/723, 726, 731

(56) References Cited

U.S. PATENT DOCUMENTS 4,236,433 A * 12/1980 Holland ..... 84/726
4,378,722 A * 4/1983 Isakson ..... 84/726
4,534,258 A * 8/1985 Anderson ..... 84/728
4,567,805 A * 2/1986 Clevinger ..... 84/731
4,911,054 A * 3/1990 McClish ..... 84/725
6,392,137 B1 5/2002 Isvan ..... 84/726

OTHER PUBLICATIONS

The Roland GR Series Analog Bass and Guitar Synthesizers, reprint from www.helpwantedproductions.com/guitsyn.htm, Exhibit B.

* cited by examiner

*Primary Examiner*—Shih-Yung Hsieh
(74) *Attorney, Agent, or Firm*—Waddey & Patterson; Lucian Wayne Beavers

(57) ABSTRACT

A guitar pickup mounting system is provided for mounting a pickup on a base plate adjacent a bridge which rides on first and second posts extending from the guitar body. Thus a height of the bridge relative to the pickup remains constant regardless of the height of the bridge above the guitar body.

11 Claims, 4 Drawing Sheets

GUITAR PICKUP SUPPORT ASSEMBLY

BACKGROUND OF THE INVENTION

1. Field of the Invention

The present invention relates generally to systems for mounting a pickup on an electric guitar, and more particularly, but not by way of limitation, to a system for mounting a pickup adjacent a bridge of a type similar to that of the GIBSON® TUNE-O-MATIC™ bridge.

2. Description of the Prior Art

The GIBSON® TUNE-O-MATIC™ bridge, and similar designs, are received on two posts extending from the body of the guitar and a height adjustment of the bridge is provided by a vertical adjustment of a thumbwheel carried by the post. FIGS. 2 and 3 of the present application disclose two prior art thumbwheel and post arrangements which have traditionally been used to support a GIBSON® TUNE-O-MATIC™ bridge and similar bridge designs.

The post and thumbwheel arrangement shown in FIG. 3 is sometimes referred to as the "standard" arrangement and it includes a fixed threaded post 10 which is threaded into a guitar body 12, and has a thumbwheel 14 which may be adjusted in height upon the post 10 by rotating the thumbwheel 14 relative to the post 10.

The post and thumbwheel arrangement shown in FIG. 2 is sometimes referred to as the "modern" design and it includes a metal casing 16 which is set in place within a bore 18 in the guitar body 12, and has a threaded internal bore 20. A post 22 having a reduced diameter non-threaded upper portion 24 and an enlarged diameter threaded lower portion 26 has an integral thumbwheel 28 which is a part of the post 22. The entire post 22 rotates relative to the casing 16. Rotation of the post 22 may be assisted by a screwdriver placed in a slot 30 in the top end of post 22.

The prior art also includes pickup designs with individual sensors for each of the six guitar strings. One such polyphonic pickup design is that shown in U.S. Pat. No. 6,392,137 to Isvan, and assigned to the assignee of the present invention, the details of which are incorporated herein by reference. Such polyphonic pickups are particularly suitable for use with synthesizers and other electronic processing equipment.

Another polyphonic pickup design was that introduced by Roland in the 1980's which included its model Gk1 pickup. The Gk1 pickup was mounted on a saddle shaped support which was placed adjacent the guitar bridge, but it was not otherwise mounted in the same manner as the present invention. The Gk1 pickup mount was a U-shaped bracket which individually attached to the guitar body by screws.

There is a continuing need in the art for an efficient and effective means to mount a guitar pickup in connection with a guitar using a traditional bridge design such as that of the GIBSON® TUNE-O-MATIC™ bridge.

SUMMARY OF THE INVENTION

The present invention provides a mounting assembly for mounting of a pickup adjacent a guitar bridge of the type of the GIBSON® TUNE-O-MATIC™ bridge. A guitar includes a guitar body and has first and second posts extending from the guitar body, the first and second posts including first and second support surfaces, respectively, which support surfaces are adjustable in distance away from the guitar body. The mounting assembly includes a U-shaped base plate having first and second legs with apertures defined through the legs for receiving the first and second posts, respectively. The base plate has a middle portion spanning between the first and second legs so that a central opening is defined in the base plate between the legs and the middle portion. A bridge, such as the GIBSON® TUNE-O-MATIC™ bridge, having apertures therethrough for receiving the first and second posts, spans across the central opening of the base plate and has the first and second posts received therein. A pickup is mounted on the base plate adjacent the bridge.

With such an assembly, the height of the bridge relative to the pickup remains constant regardless of the height of the bridge above the guitar body, because both the bridge and the pickup rest upon the base plate which is sandwiched between the pickup and the support surfaces of the posts, and all of the assembly is held in place by the tension of the guitar strings which are received across the bridge.

Accordingly it is an object of the present invention to provide an improved mounting assembly for a guitar pickup.

Another object of the present invention is the provision of a mounting assembly for mounting a pickup adjacent a bridge of the type which rides upon a pair of adjustable posts.

Still another object of the present invention is the provision of a bridge and pickup assembly wherein the height of the bridge relative to the pickup remains constant regardless of the height of the bridge above the guitar body.

Still another object of the present invention is the provision of a mounting structure for mounting a polyphonic pickup adjacent a bridge of a type similar to that of the GIBSON® TUNE-O-MATIC™ bridge.

Other and further objects features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
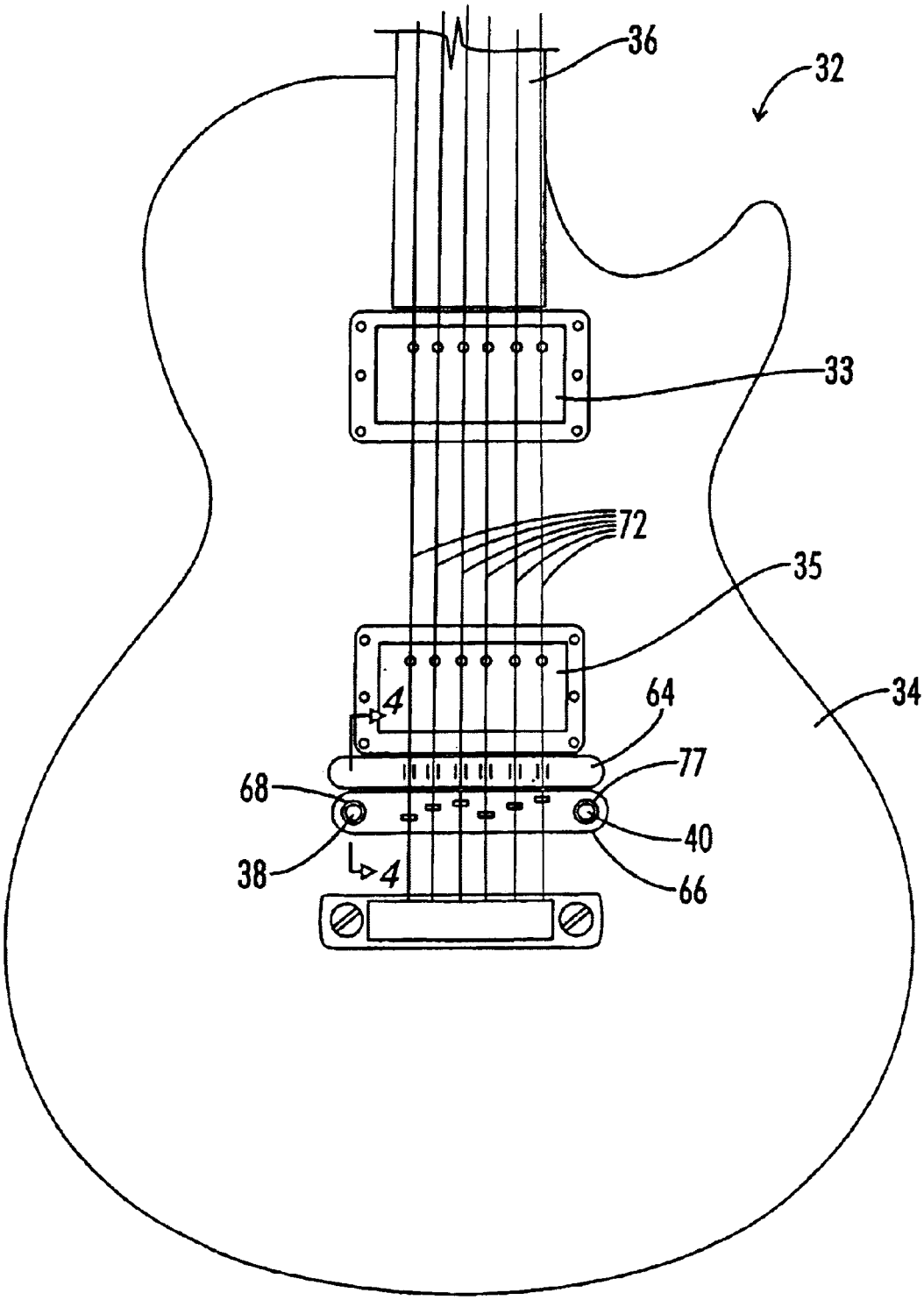
FIG. 1 is a front view of an electric guitar having a bridge and pickup assembly of the present invention mounted thereon.

Referring now to the drawings, and particularly to FIG. 1, guitar 32 includes a guitar body 34 and a guitar neck 36.

Figure 2:
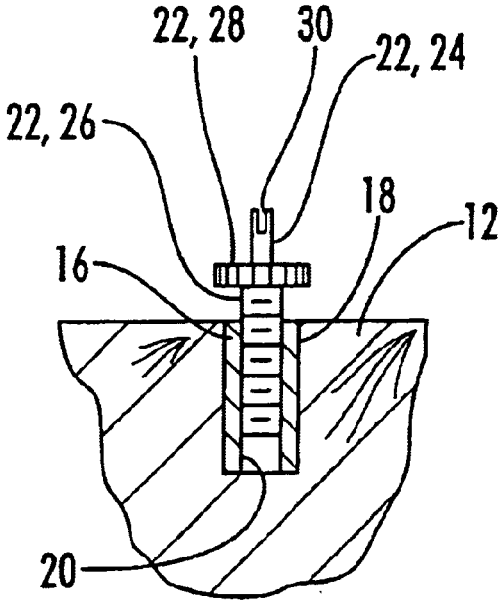
FIG. 2 (PRIOR ART)
FIG. 2 is a schematic cross-section view showing a prior art "modern" post for mounting a GIBSON® TUNE-O-MATIC™ bridge.
Figure 3:
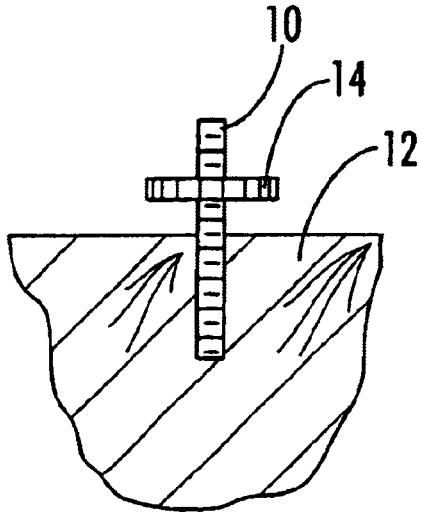
FIG. 3 (PRIOR ART)
FIG. 3 is a cross-section schematic view of a prior art design for a "standard" post for mounting a GIBSON® TUNE-O-MATIC™ bridge.
Figure 4:
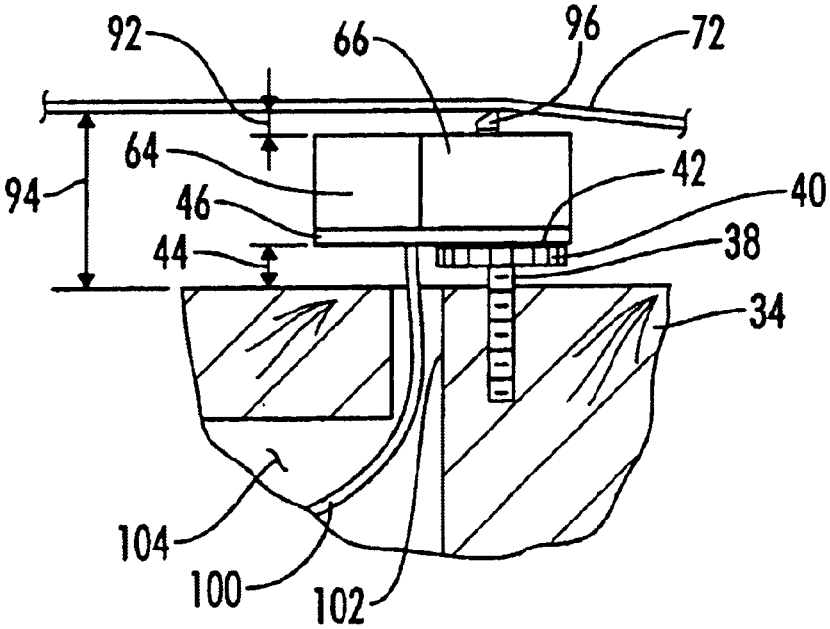
FIG. 4 is a schematic elevation cross-section view taken along line 4—4 of FIG. 1 showing the bridge and pickup assembly mounted upon the adjustable posts of the guitar body.

First and second posts 38 and 40 extend upward or outward from the guitar body 34. The first post 38 is shown in cross-sectional view in FIG. 4 and has a first thumbwheel 40 received thereon. The post and thumbwheel shown in FIG. 4 are of the "standard" variety like that shown and described with regard to FIG. 3. It will be understood that the posts 38 and 40 may also be of the "modern" variety as shown and described with regard to FIG. 2. In either event, or with any other adjustable post design, an upper surface 42 of the thumbwheel 40 can be described as a first support surface 42. The support surface 42 has a height 44 above the guitar body, which height 44 is adjustable by rotation of the thumbwheel 40.

A base plate 46 includes apertures 48 and 50 through which the posts 38 and 40, respectively, are received when the base plate 46 fits over the posts 38 and 40 as seen in FIG. 4.

The base plate 46 may be described as a U-shaped base plate having first and second legs 52 and 54 having a middle portion 56 spanning between the first and second legs so that a central opening or cutout 58 defined in the base plate 46 between the legs 52 and 54 and the middle portion 56. The base plate 46 further includes apertures 60 and 62 for mounting a pickup 64 as is further described below.

A bridge 66, which is illustrated as being a GIBSON® TUNE-O-MATIC™ bridge or bridge of similar construction, has apertures 68 and 70 through which the posts 38 and 40 are received.

As seen in FIGS. 1 and 4, the guitar 32 includes a plurality of strings 72 which are attached to the guitar body 34 and the guitar neck 36 and extend across the bridge 66 as best seen in FIG. 4, so that tension of the guitar strings 72 holds the bridge 66 and the base plate 46 upon the support surfaces 42 of the posts 38 and 40.

Figure 5:
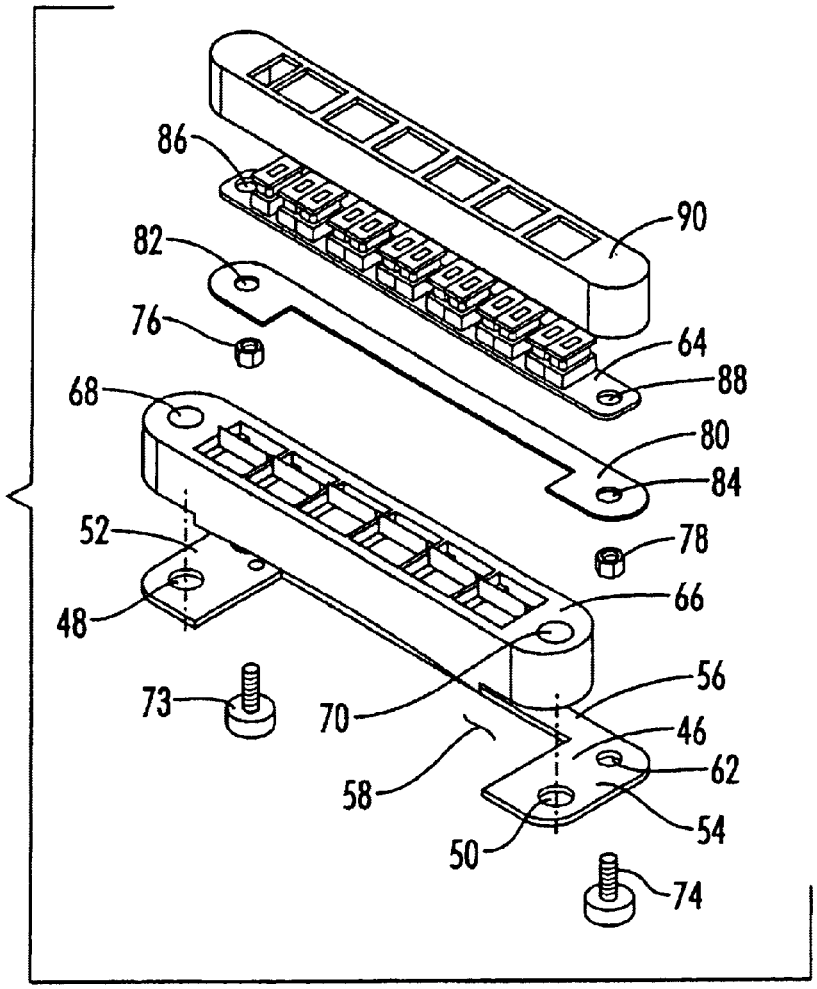
FIG. 5 is an exploded view of the mounting assembly including the bridge and pickup.
Figure 6:
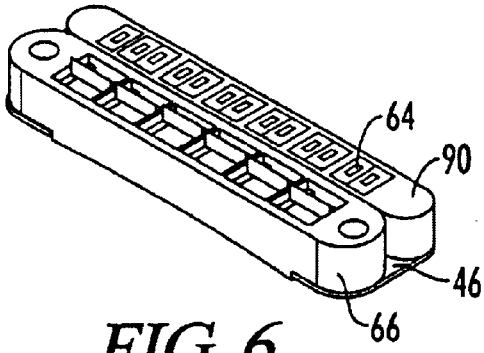
FIG. 6 is an upper perspective view of the assembly of FIG. 5 assembled.
Figure 7:
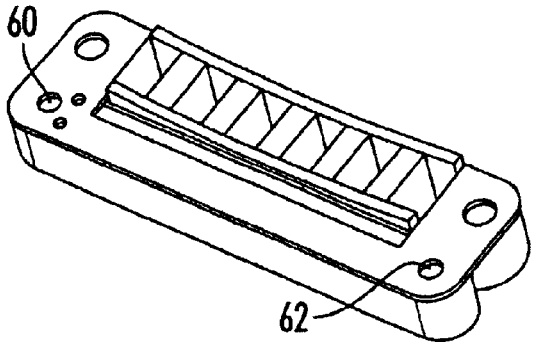
FIG. 7 is a bottom perspective view of the apparatus of FIG. 6.
Figure 9:
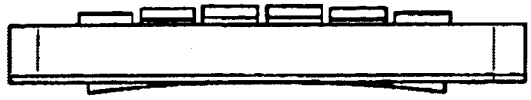
FIG. 9 is a top view of the apparatus of FIG. 8.
Figure 11:
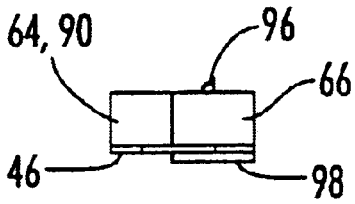
FIG. 11 is a left side view of the apparatus of FIG. 8.
Figure 12:
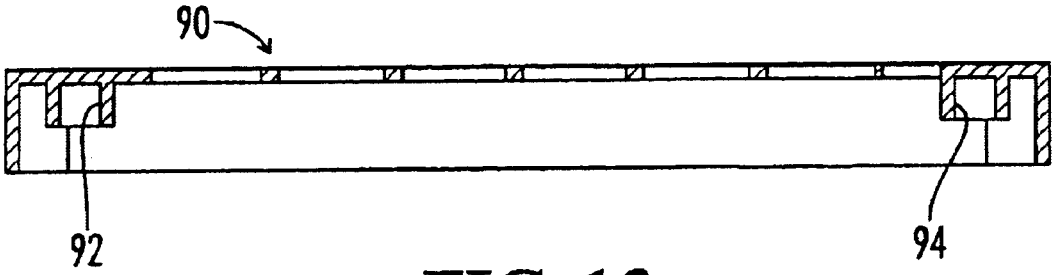
FIG. 12 is a cross-sectional view of the pickup cover.

The pickup 64 is also mounted upon the base plate 46, and the method of mounting is best described with reference to the exploded view of FIG. 5. A pair of screws 73 and 74 extend upward through apertures 60 and 62 of base plate 46. Spacer nuts 76 and 78 are received over screws 73 and 74, respectively. An electrical insulator 80 overlays the spacer nuts 76 and 78 and has apertures 82 and 84 through which the screws 73 and 74 are received. The pickup 64 is placed on top of the insulator 80 and has apertures 86 and 88 through which the screws 73 and 74 are received. A molded plastic cover 90, which is shown in cross-sectional view of FIG. 12, has molded threaded cylindrical bores 92 and 94 defined therein within which the upper ends of screws 73 and 74 are embedded so as to hold the cover 90, the pickup 64, the insulator 80, the spacer nuts 76 and 78 and the base plate 46 all in a tight sandwiched engagement. FIGS. 6–11 all show the pickup 64 with the cover 90 and the bridge 66 all assembled with the base plate 46.

Figure 10:
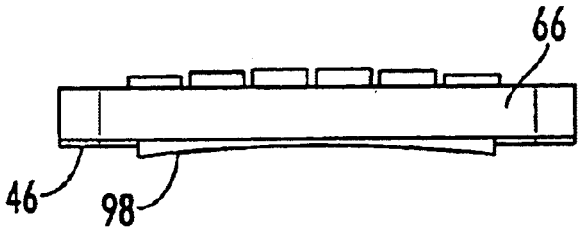
FIG. 10 is a bottom view of the apparatus of FIG. 8.

As best seen in FIG. 10, the bridge 66 has a downward extending arcuately shaped portion 98 which is received in the cutout 58 of the base plate 46.

Pickup 64 is preferably a polyphonic pickup constructed in accordance with the teachings of U.S. Pat. No. 6,392,137, the details of which are incorporated herein by reference, but other pickup designs could be utilized with the mounting system of the present invention.

As seen in FIG. 1, the guitar 32 also may utilize other conventional pickups such as pickups 33 and 35 which are mounted directly upon the guitar body in the traditional manner.

With the mounting arrangement just described, the bridge 66 and the pickup 64 are both securely supported from the base plate 46 with the pickup 64 adjacent the bridge 66. Thus when the height of the bridge 64 is adjusted relative to the guitar body 34 by rotation of the posts 38 and 40 and/or the thumbwheels associated therewith, the entire assembly is raised relative to the guitar and thus a height 92 of the bridge 66 relative to the pickup 64 remains constant regardless of a height 94 of the bridge 66 above the guitar body 34.

As will be understood by those skilled in the art, the bridge 66 includes bridge saddles 96 which engage the strings 72 and thus determine the height of the strings 72 above the guitar body 34. The height 92 of the saddle 96 of bridge 66 above the pickup 64 is thus also the distance between the strings 72 and the pickup 64 which is of course critical to the proper functioning of the pickup 64. In a conventional pickup mounting where the pickup is affixed to the guitar body 34, this distance between the string and the pickup varies as the height of the bridge 66 is adjusted. With the present invention, however, the distance 92 remains constant regardless of the height 94 of the bridge 66 and the strings 72 relative to the guitar body 34.

As best illustrated in FIG. 4, the base plate 46 can be described as extending laterally from under the bridge 66 toward the guitar neck 36.

Figure 8:
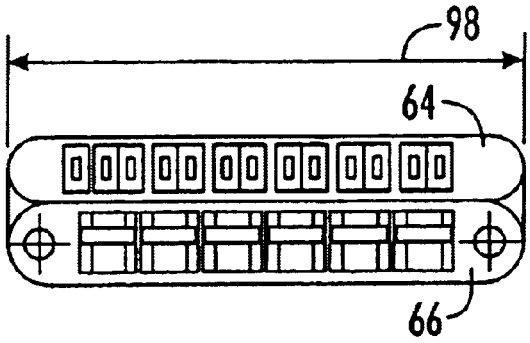
FIG. 8 is a front view of the apparatus of FIG. 6.

As best seen in FIGS. 1 and 8, the bridge 66 and the pickup cover 90 are both oval shaped and have essentially equal widths 98.

As will be understood by those skilled in the art, the pickup 64 will include an electrical cable or wiring 100 leading therefrom to carry the sensed electrical signals corresponding to movement of the guitar strings 72 to electronic components mounted on the guitar and in some cases external of the guitar. This wiring 100 is schematically illustrated in FIG. 4. This wiring 100 passes from the pickup 64 down through the cutout or central opening 58 of base plate 54 then through a wiring port 102 defined through the guitar body 34 which leads to an interior cavity 104 of the guitar body 34.

Thus it is seen that the apparatus and method of the present invention readily achieves the advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A guitar, comprising:

a guitar body and a guitar neck;

first and second posts extending upward from the guitar body, the first and second posts including first and second support surfaces, respectively, the support surfaces being adjustable in height above the guitar body;

a U-shape base plate received on the posts above the support surfaces, the base plate having a cutout defined therein;

a bridge received on the posts above the base plate;

a plurality of guitar strings attached to the guitar body and the guitar neck and extending across the bridge, so that tension of the guitar strings holds the bridge and the base plate on the posts; and a pickup mounted on the base plate and spanning the cutout, so that a height of the bridge relative to the pickup remains constant regardless of a height of the bridge above the guitar body.

2. The guitar of claim 1, wherein:

the bridge has a downward extending portion received in the cutout of the base plate.

3. The guitar of claim 1, wherein:

the base plate and the bridge each have a pair of apertures therethrough, the first and second posts being received through the apertures of both the base plate and the bridge so that the base plate and the bridge are supported by the support surfaces of the posts.

4. The guitar of claim 1, wherein:

the base plate extends laterally from under the bridge toward the guitar neck; and the pickup is mounted on the base plate adjacent the bridge.

5. The guitar of claim 4, wherein:

the bridge is oval shaped and has a bridge width; and the pickup includes an oval shaped pickup cover having a cover width equal to the bridge width.

6. The guitar of claim 1, wherein:

the guitar body includes a wiring port communicated with an interior of the guitar body;

the base plate includes a cutout located above the wiring port; and the pickup includes an electronic cable extending through the cutout of the base plate and through the wiring port.

7. The guitar of claim 1, wherein:

the support surface of each post includes an outer surface of a thumbwheel attached to the post.

8. The guitar of claim 7, wherein:

the post is a fixed threaded post and the thumbwheel is threadedly engaged with the post so that the thumbwheel is rotatable relative to the post.

9. The guitar of claim 7, wherein:

each post and its associated thumbwheel are fixed relative to each other; and a lower portion of each post threadedly engages a threaded opening in the guitar body so that the post is rotatable relative to the guitar body.

10. A bridge and pickup assembly for a guitar, the guitar including a guitar body and first and second posts extending from the guitar body, the first and second posts including first and second support surfaces, respectively, the support surfaces being adjustable in distance away from the guitar body, the assembly comprising:

a U-shape base plate having first and second legs with apertures defined through the legs for receiving the first and second posts, respectively, the base plate having a middle portion spanning between the first and second legs, so that a central opening is defined in the base plate between the legs and the middle portion;

a bridge having apertures therethrough for receiving the first and second posts, the bridge spanning across the central opening of the base plate;

a pickup mounted on the base plate adjacent the bridge; and wherein the bridge has a lower extension which protrudes into the central opening of the base plate.

11. The assembly of claim 10, wherein:

the pickup includes an electrical cable that extends through the central opening of the base plate.

* * * * *